United States Patent [19]

Handa et al.

[11] 4,134,253

[45] Jan. 16, 1979

[54] METHOD AND APPARATUS FOR WINDING ROVING WITH CONSTANT TENSION ON BOBBIN ON BOBBIN-LEAD TYPE ROVING FRAME

[75] Inventors: Kiyoyasu Handa, Nagoya; Hiroaki Yuzuriha, Takarazuka, both of Japan

[73] Assignee: Aichi Spinning Co., Ltd., Aichi, Japan

[21] Appl. No.: 887,118

[22] Filed: Mar. 16, 1978

[30] Foreign Application Priority Data

Apr. 1, 1977 [JP] Japan ..... 52-036066

[51] Int. Cl.[2] ..... D01H 1/26

[52] U.S. Cl. ..... 57/96; 57/264

[58] Field of Search ..... 57/34 R, 93, 94, 96, 57/156; 19/239–241

[56] References Cited

U.S. PATENT DOCUMENTS

| | | | |
|---|---|---|---|
| 1,846,715 | 2/1932 | Gegauff | 57/96 |
| 3,089,302 | 5/1963 | Williamson, Jr. | 57/96 |
| 3,892,064 | 7/1975 | Araki et al. | 57/96 |

*Primary Examiner*—John Petrakes

*Attorney, Agent, or Firm*—Merchant, Gould, Smith, Edell, Welter & Schmidt

[57] ABSTRACT

In converting a sliver into a roving on a bobbin-lead type roving frame, the speed of a bobbin is controlled in accordance with a slight difference between the roving tension and a predetermined tension, so that the roving can be wound onto the bobbin while a predetermined constant tension is maintained, in such a way that controlling of the speed of the bobbin can result from a fine adjustment of the delivery speed of a variable speed driving mechanism in accordance with the result of comparing a given frequency corresponding to the predetermined tension with a frequency of the vibration corresponding to a tension on the roving being wound, wherein such vibration of the roving is induced by lateral forces applied upon the roving running from the nip of the front roller to the top of the flyer at time intervals equal to time intervals corresponding to the frequency of the vibration of the roving, and such external forces are applied upon the roving during the time when the vibrating roving is moving or oscillating downwardly from the uppermost point to the lowermost point, or upwardly from the lowermost point to the uppermost point.

22 Claims, 10 Drawing Figures

1
2
3
4
5
6
7
8
9
10
11
12
20
21
22
23
24
30
32
33
34
40
41
42
43
50
60
80
81
82
83
84
85

80
VCC
54
L1
50
51
52
53
e
A3
C3
d
D1
A2
R2
R1
c
C2
b
A1
a
C1
70
71
66
65
64
63
F / V CONVERTER
81
f
COMPARATOR
82
g
VR1
VCC
h
i
R3
Q1
X1
R4
Q2
X2
X3
Q3
R5
83
85

METHOD AND APPARATUS FOR WINDING ROVING WITH CONSTANT TENSION ON BOBBIN ON BOBBIN-LEAD TYPE ROVING FRAME

The present invention is related to a roving frame, which winds a roving onto a bobbin, while the tension of the roving being wound at a constant predetermined level is maintained. More particularly, the roving tension can be maintained at a constant level by controlling the rotation of the bobbin in such a way that the rotation is controlled in accordance with a detected tension of the vibrating roving which is extended and running between the front roller of a drafting assembly of the frame and the top of the flyer. The detection can be carried out in such a way that no mechanism of the detecting device and the like is ever brought into contact with the roving during the measuring operation. The detecting device can detect the frequency of the vibration of the extended roving which corresponds to the roving tension and which is induced by external forces.

Generally, during an ideal winding of a roving onto a bobbin located on a bobbin-lead type roving frame, the tension occurring on the roving being wound onto the bobbin and running from the front roller to the top of the flyer is always maintained at constant from the time when the roving is wound onto the bare surface of the bobbin to the time when the roving is wound onto the outer surface of a wound package.

However, on almost all of the presently used roving frames, a roving is wound on a package with a different tension because the varied speed of the bobbin does not correspond to the tension, but corresponds to the speed variation which is derived from the variation curve of the controlling device installed on such roving frames. Such control is effected only at the beginning of winding a new layer of roving on a preceding layer of roving already wound onto a package or bobbin. The controlled speed is maintained without any changes during the complete winding of one layer.

Variation of the bobbin speed is largely caused by the mechanisms of the controlling device. The variation of the bobbin speed which is suitable for one kind of roving as controlled by the above-mentioned device is not suitable for another kind of roving. Various factors for defining a particular kind of roving are:

(a) the kind of fibrous material within the roving;
(b) the number of twists per unit length produced on the roving;
(c) the thickness of a roving being wound;
(d) the physical properties of the fibrous material;
(e) the frictional resistance occurring on the surface of a flyer, which prevents a roving from moving thereon and which affects the tension of a roving being wound;
(f) the number of revolutions of a flyer, and;
(g) the thickness of each of the layers within one package.

The thickness of each layer is not constant, i.e., the inner layer is thin, while the outer layer is thick, because a roving constituting the wound layer does not have a round cross section. Namely, the cross section of a roving constituting an inner layer shows an oval configuration with a small thickness, while the cross section of a roving constituting an outer layer shows an oval configuration with a large thickness. This difference between the cross sections of a roving can prevent an ideal winding from being obtained.

If the thickness of an outer layer is greater than the expected thickness, then the speed of a roving being wound onto the surface of a package rotating at a given speed will be faster than the expected speed. The ideal winding condition is one wherein the speed of a roving being wound onto a bobbin or onto a package equals the speed of the roving being delivered from the front roller of a draft assembly. Consequently, if the winding speed exceeds the delivery speed, then the tension of a roving running from the nip of the front roller to the top of the flyer becomes stronger than the expected tension.

If the winding speed is lower than the delivery speed, then the roving running from the front roller to the top of the flyer will show a sagging travelling passage. If there is too much sagging, then there is a great chance for the roving to be damaged. If a roving tension is too high, then an irregular roving will be drafted.

Consequently, to obtain an optimum winding of a roving onto a package, the winding condition of the roving must be maintained at constant during the time when the roving is being wound onto a bare surface of the bobbin as well as during the time when the roving is being wound onto an outside layer of the roving of a wound package. In almost all of the presently used roving frames, the tension of the winding on a bare surface of the bobbin is usually smaller than that of the winding on an outer surface of the package. Therefore, if it is required to reduce an increased tension, then it is necessary to manually adjust the turning speed of the package. However, it is impossible to maintain a constant roving tension by means of such manual adjustment.

It is a common practice to carry out the above-mentioned manual adjustment only when the running roving passage is sagging extremely downwardly, which condition can be detected by the naked eye. However, such detection by means of the naked eye is not feasible when the roving tension is abnormally increased. Due to the abnormally increased roving tension, the passage of the roving will be a straight line extending from the nip of the front roller to the top of the flyer. Even if the tension is furthermore increased, no change will occur in the straight line passage. Accordingly, changes in the roving tension cannot be detected by the naked eye. As a result, a serious drawback is caused wherein a full package of the roving bobbin contains an irregularly drafted roving.

Another drawback of the presently used roving frames results from the design for a variable speed drive mechanism of the bobbin.

The most frequently used device for driving a bobbin at variable speeds is a device which consists of a convex cone drum and a concave cone drum. In such a device, a cone drum belt is moved along the drums for a predetermined constant distance every time one layer is newly wound onto an outermost layer of the package. Contrary to this, another device uses two straight cone drums, in which device a cone drum belt is moved along the drums at a variable distance every time one layer is newly wound onto an outermost layer of the package. A nonstep variable speed driving mechanism, such as a PIV system, is also used in place of the cone drum system.

For all of the three systems mentioned above, a fundamental curve, showing the bobbin speed versus the number of layers wound onto the package is generally defined in accordance with the design of the mechanism used, i.e., in accordance with the configurations of the two drums used.

To modify such a speed changing curve, some adapter systems can be used in combination with the variable speed driving mechanism, i.e., with fundamental speed changing devices, so that a curve modified from the fundamental curve can be obtained by using the adapter. However, this type of adapter can be used for a complete and not a partial modification curve. Generally, for a roving to be wound onto a bobbin while a predetermined constant tension is maintained on a roving frame provided with any one of the variable speed driving mechanisms mentioned above, it is indispensable that the speed changing curve corresponds exactly to the roving tension, which tension occurs from the time a first layer of the roving is being wound onto a bare bobbin to the time the last layer of the roving is being wound onto the outer surface of the package. Such winding condition is hereinafter referred to as an optimum speed change.

A known concept is used to obtain the above-mentioned optimum variable speed. This concept consists of the step of sensing the abnormal sagging of the roving being processed wherein the roving is running from the front roller to the top of the flyer. According to this concept, the bobbin speed is controlled by a sensing device which measures the roving tension and generates a pulse which is proportional to the sagging of the roving, thereby causing the variable speed bobbin driving mechanism to reduce its output speed by a certain amount. However, this system has the following drawback in that when measuring the roving tension by means of the sensing device, it is indispensable that the roving to be measured is running in a sagging condition. Since the straightness of the running passage does not change even under increasing tension, it is impossible for the sensing device to detect a very strong roving tension.

The object of the present invention is to provide a new apparatus which does not exhibit any of the drawbacks described above.

By means of the method of the present invention, a roving running from the nip of the front roller to the top of the flyer can be wound onto a bobbin while a constant tension is maintained from the time when the first layer of the roving is wound onto the bobbin until the time when the last layer of the roving is wound onto the outer surface of the package.

When the roving tension varies from a predetermined tension due to a layer being wound on a preceding layer, a fine adjustment of the speed of the bobbin can be carried out in accordance with the variation of the roving tension.

The roving tension occurring on a roving delivered from the nip of the front roller and moving toward the top of the flyer along a slightly sagging travelling passage or along an almost straight line passage, such roving tension can be represented by the frequency of the vibration of the roving. Since the frequency of the vibration of the roving is increased in accordance with the increase of the roving tension, therefore, by forcibly vibrating the roving by applying external forces upon the roving at time intervals equal to time intervals corresponding to the frequency of the vibrating roving, preferably at a position of the roving which is almost halfway between the nip of the front roller and the top of the flyer, such time intervals corresponding to the frequency can be used to represent the values of the tension strength.

By applying a force upon a roving which is oscillating downwardly when the downward moving speed is at maximum, or which is oscillating upwardly when the upward moving speed is at maximum, the vibration of a roving being wound onto a bobbin or package can be maintained for a long time. Furthermore, by vibrating the roving within a space without causing the roving to touch any of the measuring instruments, such vibration can be easily maintained.

The measured frequency is compared with the predetermined frequency. If a difference exists therebetween, such difference is used, in accordance with the present invention, as a means for finely adjusting the speed of a bobbin or package for slightly increasing or decreasing the speed from the fundamental speed until the frequency of the vibration of the roving is equal to the frequency of the predetermined vibration.

It is well known that a vertical vibration occurs commonly on a roving which is delivered from the nip of the front roller and then passed through a center hole of the top of the flyer when outside forces are not applied upon the roving. Consequently, such vibration induced by the external forces cannot cause the quality of the roving to be degraded.

Another object of the present invention is to provide an apparatus which is simple and small in construction for sensing a roving tension as well as for finely adjusting the speed of a bobbin in addition to the normal varied bobbin speed, so that the roving can always be wound with a constant tension.

The apparatus of the present invention consists of an air pump which ejects one air jet upon a roving at time intervals equal to time intervals corresponding to the frequency of the vibration, a light beam source and two light receivers, wherein each of the receivers is mounted on one of the prism-like chambers provided with a light receiving zone so that the moving direction of the vibrating roving can be detected, especially the downward movement of the roving.

A device for comparing the frequency of a vibrating roving with a predetermined frequency is provided in the apparatus of the present invention, so that when a difference between the two frequencies is detected, then the result of such detection is used for finely adjusting the bobbin speed until the frequency of the vibrating roving is equal to the predetermined frequency.

Thus, if the tension of the roving which is being wound is stronger than the predetermined tension, then the speed of the bobbin should be slightly reduced; while if the tension of the roving is weaker than the predetermined tension, then the speed of the bobbin should be slightly increased.

Decreasing or increasing of the bobbin speed can be effected by means of a fine adjusting device of the present invention. This device can be applied to the conventional variable speed mechanism with some modifications. Accordingly, the apparatus of the present invention can be easily applied to a conventional mechanism provided on any presently used roving frame.

By incorporating the present device into a roving frame used in a spinning mill, all of the rovings wound on respective packages can be tensioned by using a predetermined tension. Accordingly, the quality of the yarns spun from the rovings on the successive spinning frame is tremendously improved.

Other objects and features of this invention will become more apparent from the following description of the embodiments with reference to the appended drawings in which.

Figure 1:
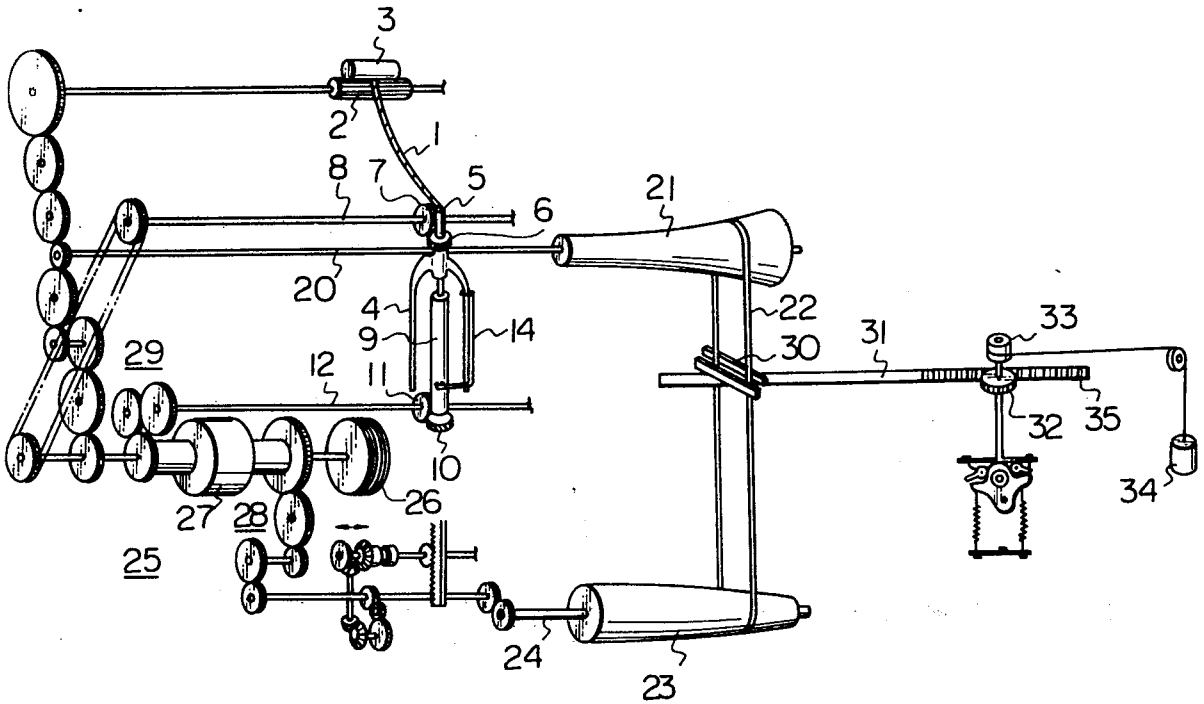
FIG. 1 shows a gearing diagram of a roving frame provided with a cone drum mechanism, a flyer driving mechanism, and a bobbin driving mechanism, wherein a roving runs from the front rollers to the top of the flyer.

In a roving frame, a sliver or a coarse roving fed into the frame is attenuated into a finer roving which is then wound onto a bobbin for the production of a roving package. For manufacturing a package on the roving frame, a flyer and a bobbin in addition to several sources for driving these elements are indispensable. The number of revolutions of the flyer can be calculated from the predetermined number of twists per unit length of a roving being produced, and from the delivery speed of the roving being delivered from a front roller. The number of revolutions of the bobbin can be determined from the number of revolutions of the flyer and from the delivery speed of a roving being delivered from the front roller. The number of revolutions of the flyer is always constant, while the number of revolutions of the bobbin is varied in such a way that the speed of the bobbin can be determined from the following relation wherein the length of the roving delivered from the front roller is maintained equal to the length of the roving being wound onto a bobbin or to the length of the roving being wound onto an outer surface of a package. This means that, when a roving frame is a bobbin-lead type machine, the speed of the bobbin is high when a first layer of roving is being wound onto the bare surface of a bobbin; while such speed is low when the last layer of roving is being wound onto the outer surface of a package. Consequently, when a layer of roving is being wound onto a preceding layer of roving, the speed of the bobbin used for winding the preceding layer must be reduced by a suitable extent to a bobbin speed which is appropriate for winding a layer of roving onto a package.

The bobbin speed results from combining a constant speed maintained by a driving source of the frame and a variable speed induced by a variable speed drive mechanism. The resultant combined bobbin speed can be generated by using a differential gear mechanism which is disposed between the two driving sources and the driven bobbin. When manufacturing an ideal roving package, the roving winding must be carried out under a condition wherein a predetermined roving tension is maintained.

As mentioned above, an increase in the diameter of a package is not exactly proportional to an increase in the number of the layers of the roving being wound, i.e., the increase of the diameter is larger than the increase of the number of layers. The degree of this unproportional relationship between the diameter and the number of layers is varied when another kind of roving is utilized.

Even if different kinds of rovings are being wound, such rovings can still be wound with a constant predetermined tension by means of the method of the present invention, which can be used to control the fundamental variable speed curve for adjusting a bobbin speed to a speed which is suitable for the winding condition mentioned above.

Several types of variable speed devices are now applied to the above-mentioned roving frame. One of these types in a cone-drum device, which consists of a convex cone and a concave cone with a hyperbolic shape. In this device the required speed variation can be obtained by displacing the cone drum belt by a constant distance at every traverse of a bobbin rail (not shown) to wind a layer of roving.

In FIG. 1, a typical gearing of a roving frame using a pair of hyperbolic-shaped cone drums is shown.

As shown in FIG. 1, a flyer 4, is rotated at a given speed by a motor (not shown) via a driving pulley 26 of this frame, by using a flyer driving shaft 8, a flyer driving wheel 7 mounted on the driving shaft and a flyer wheel 6 fixedly mounted on the flyer 4. A front bottom roller 2 is also rotated at a given speed by means of the motor via a suitable gear train. A roving 1 to be wound onto a bobbin or package is delivered from the front bottom roller 2 and then runs from the nip point between the front bottom roller 2 and a front top roller 3 to a top 5 of the flyer, so that the roving 1 can approach toward the surface of bobbin 9 after passing through a hole or passage of the flyer 4, while being guided by a flyer pressor 14.

The bobbin 9 is also rotated by the same motor driving source through a differential gear 27 by means of a gear train 29 of a differential drive, a bobbin driving shaft 12, a bobbin driving wheel 11 mounted on the shaft, and a bobbin wheel 10 which drives the bobbin 9 supported by a long collar (not shown). A cone drum type variable speed driving mechanism is provided on a roving frame. The input rotating movement of the mechanism is driven by the same motor driving source via a proper gear train and a top cone drum shaft 20, while the output rotating movement of the mechanism caused by a bottom cone drum shaft 24 of the mechanism is transferred to the differential gear 27 through a gear train 28 for driving the bobbin.

A cone drum type variable speed driving mechanism consists of a top cone drum 21 of a concave shape mounted on the top cone drum shaft 20 and a bottom cone drum 23 of a convex shape mounted on the bottom cone drum shaft 24. A cone drum belt 22 is arranged on the two cone drums so that it extends over the two cone drums for transporting the turning movement of the top cone drum 21 to the bottom cone drum 23. Furthermore, the cone drum belt 22 can be displaced with respect to the top and bottom cone drums from the right side to the left side in FIG. 1, stepwisely, i.e., by a constant amount of belt displacement at every roving layer being newly wound on a package. The belt displacement is guided by a belt fork 30 mounted on a long rack 31 having rack teeth 35. The horizontal displacement of the long rack 31 can be effected by a dead weight 34 via a mechanism of a stepwisely releasing and stopping device provided with a weighting drum 33, and via a rack gear 32 mounted coaxially on a shaft on which the weighting drum 33 is fixedly mounted. By this arrangement, the long rack 31 can be displaced toward the left by a constant length at every newly wound layer, and such displacement corresponds to a given number of the rack teeth 35 which are moved by the action of the dead weight 34.

Corresponding to the displacement of a long rack 31 as well as to the displacement of a cone drum belt 22 along the surfaces of the cone drums, a constant speed of the top cone drum can be converted into a varied speed of the bottom cone drum 23. Therefore, the speed of the bobbin 9 can be varied in accordance with a speed variation curve as determined by the shape of cone drums 21 and 23 as shown by the stepped curve N in FIG. 2.

If the roving 1 is subjected to a tension which is different from a predetermined tension, the winding of the roving is then not at optimum. To wind a roving under an optimum condition, the speed of a bobbin speed must be increased or decreased slightly for finely compensating the bobbin speed, as shown by the curve F in FIG. 3.

By utilizing the result of the detection by a device of the present invention, the compensation or control of the bobbin speed can be carried out only when a condition corresponding to an "out-of-order" roving tension occurs. Even if such condition is detected by sensing the degree of sagging of a roving by means of a device which is different from the present device, the detected result, however, cannot be used to correctly detect the tension occurring in the roving, especially when the roving is running along a straight passage.

A conventional roving frame is usually provided with a front row of flyers and a back row of flyers. In such case, the length of the roving 1 running from the nip point of the bottom front roller 2 to the top 5 of a specific flyer 4 within either the front or the back row of flyers in a given roving frame is constant. Under such condition, if a roving moves from the nip point to the top of the flyer and if such roving is twisted by the rotation of the roving together with the specific flyer 4, the roving can be forcibly moved up and down in accordance with a specific frequency of the vibration which should correspond to the amount of roving tension occurring at that time. Namely, the stronger the tension is, the higher the frequency, and vice versa. The relation between the roving tension and the frequency of the vibration is always consistent even when the roving is sagging.

By measuring the frequency of the vibration which corresponds to the roving tension in the case wherein the roving has been vibrating for a long time, fine adjustment of the speed of a bobbin can be performed in accordance with the measured results. Thus an optimum winding of a roving onto a package can always be expected during the winding period from the time when the first layer of roving is wound onto a bare surface of a bobbin until the time when the last layer of roving is wound onto the outside surface of package.

In the method of the present invention, an external force is applied onto the vibrating roving, so that up and down movements of the roving can be maintained for a long time. It is preferable that such external force be applied onto the roving at a middle position thereof between the front roller and the top of the flyer. By applying the external force at a time interval, which corresponds to the frequency of a vibrating roving, onto the vibrating roving, the up and down movements of the roving are maintained without any decrease in the degree of the up and down movements. The most preferable time to apply an external force upon the vibrating roving is when the roving is moving downwardly and, especially, when the roving is moving at the highest downward speed. Accordingly, the oscillation of the roving can be prevented from being damped. Such oscillation is maintained by accelerating the downward movement of a roving by means of applying an external force to the roving.

By following the above-mentioned way, a specific frequency of the vibration, which corresponds to the roving tension, can be maintained for as long as the tension of the roving is not changed.

As external forces are applied onto the roving at time intervals which are equal to time intervals corresponding to the frequency of the vibrating roving, such time intervals can therefore be used to measure the tension occurring on a roving. Accordingly, the frequency of the roving vibration can be measured by means of a device of the present invention, as described hereinafter. The condition in which a roving is moving downwardly can be detected by disposing the roving between a light source and a light beam receiving plate, so that the silhouette of the roving can be projected onto the light beam plate in order to measure the tension of the tension.

The light beam receiving plate 64 has two triangular receiving zones, i.e., one is an upper light receiving zone 66 with its apex on the bottom, while the other is a lower light receiving zone 65 sharing a common apex with that of the zone 66, arranged in such a way that both triangular zones 66, 65 are positioned symmetrically on either side of the common apex.

By projecting the image of a roving onto the light beam plate by means of the light beam emerging from the light source, and by inspecting a silhouette of the roving on the plate, the moving direction of the roving can be detected.

Figure 5:
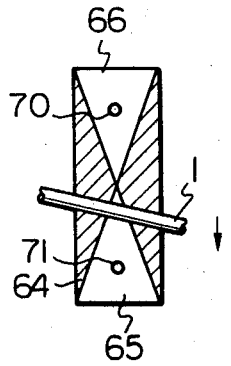
FIG. 5 shows the front view of light beam receiving zones on a receiving plate of the present invention used for determining the moving direction of the vibrating roving.

When projecting the silhouette of the vibrating roving onto the light beam receiving plate 64, as shown in FIG. 5, the following three case can be observed. In the first case, a roving 1 vibrating within the area of the upper light receiving zone 66 can be seen. In the second case, the uppermost point of the roving vibration is observed to be situated within the upper light receiving zone 66, while the lowermost point of the vibration is observed to be situated within the lower light receiving zone 65. In the third case, a roving 1 vibrating within the area of the lower light receiving zone 65 can be seen.

In the case in which the silhouette of the roving is projected onto the light beam receiving plate 64, if the silhouette is projected onto the triangular area, then the bright area of the triangle is reduced by the silhouette. As the length of the silhouette appearing on the triangle varies in accordance with the location of the silhouette within the triangle, the bright area is correspondingly varied.

In the first case, if the roving 1 is moved downwardly, the length of the silhouette is gradually reduced while the bright area is gradually increased. In the third case, the length of the silhouette is gradually increased while the bright area is gradually decreased. To determine the downward movement of the vibration of a roving, repeated inspections of the roving are carried out to obtain detected results with respect to the triangular bright areas which also include dark areas therein by means of an upper measuring device and a lower measuring device, such as the light receivers 70, 71, respectively.

Figure 6:
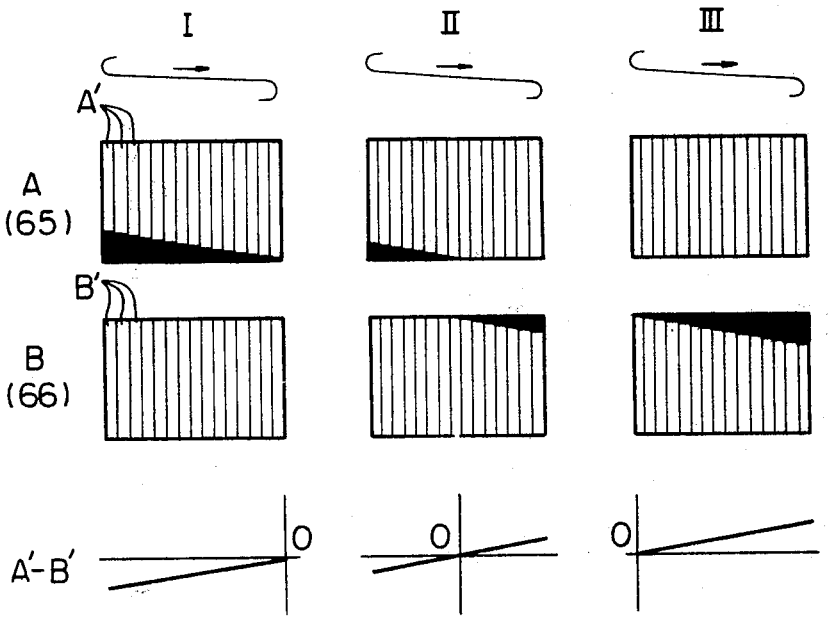
FIG. 6 shows the bright areas produced on the light beam receiving zone when a roving is moving downwardly, and also shows a graph indicating the tendency of the resultant bright area to increase.

When converting the amount of bright area of the upper triangular light receiving zone 66 into a rectangular area with a narrow width such as A' and also converting the amount of bright area of the lower triangular light receiving zone 65 into a rectangular area of a narrow width such as B', the entire rectangular area of A in FIG. 6 represents a plurality of the areas A' arranged side by side and the entire rectangular area of B in FIG. 6 represents a plurality of the areas B' arranged side by side.

Consequently, the white area of A' represents the bright area of the upper triangular light receiving zone 66, and the black area of A' represents the dark area (i.e., silhouette area of a roving 1) on the upper triangular light receiving zone 66.

FIG. 6-I illustrates the above-described first case; FIG. 6-II illustrates the above-described second case; and FIG. 6-III illustrates the above-described third case.

In the first case, since the upper triangle of the triangular light receiving zone 66 has a dark area and since the lower triangle of the light receiving zone 65 does not have any dark area, therefore, the corresponding rectangular area A' has a black area, but the corresponding rectangular area B' does not have any black area.

When the white area of B' is subtracted from the white area of A', the resultant area is expressed by a negative value. Resultant values from such substracted areas, when plotted on a graph, form a straight line which approaches the origin as illustrated in the graph A'-B' shown under FIG. 6-I.

Contrary to this, in the third case, since the upper triangle of the light receiving zone 66 has no black area, and since the lower triangle of the light receiving zone 65 has a black area, when the white area of B' is subtracted from the white area of A', the resultant value of the substracted areas is a positive value. Resultant positive values, when plotted on a graph, form a straight line starting from the origin as shown in the graph A'-B' shown under FIG. 6-III.

Similarly, in the second case, the plotted resultant values form a straight line passing through the origin, which starts in the third sector and passes into the first sector of the graph A'-B' shown under FIG. 6-II. From the three A'-B' graphs, shown under FIGS. 6-I, -II and -III, the three straight lines respectively representing the resultant values of calculated areas all show a similar tendency, i.e., all three lines incline upward toward the right side of the graphs.

From the three graphs, the same inclination of the slanting lines indicates that the roving is moving downwardly in all three cases. Accordingly, the directions of the plotted lines can be used to determine the direction in which the roving is moving.

Figure 7:
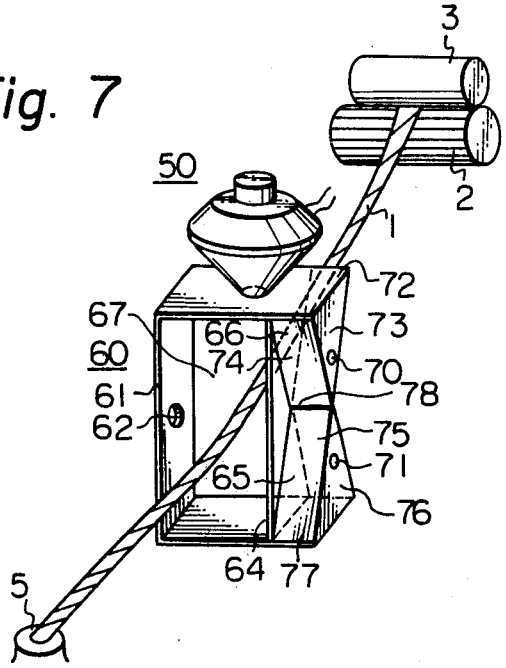
FIG. 7 shows a partial perspective view of a roving running from the front roller to the top of the flyer, a vibrating device and a roving tension measuring device of the present invention.
Figure 8:
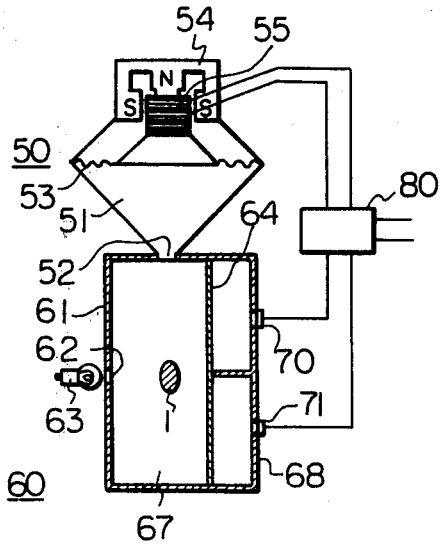
FIG. 8 shows a diagram indicating a combination of the vibrating device, the roving tension measuring device, and an amplifier.

As shown in FIGS. 7 and 8, a roving tension measuring device of the present invention consists of a roving vibration device 50 and a moving direction inspecting device 60.

The moving direction inspecting device 60 consists of one vertical screen plate 61 provided with one hole 62, through which a light beam emerging from a light beam projecting source 63 can pass, and two light receiving boxes. Between the vertical screen plate 61 and the light receiving plate 64, a space 67 is provided through which a roving 1 can vibrate and pass, respectively. On the inside light beam receiving plate 64, the upper light beam receiving zone 66 and the lower light beam receiving zone 65 are formed. At the side of the plate 64, two prism-shape boxes are arranged. One of the prism-shape boxes is an upper box with an edge line 78. This upper box is provided with a light receiver 70 on its outer end surface. The other prism-shape box is a lower box with the common edge line 78. This lower box is provided with another light receiver 71 on its outer end surface. Consequently, the upper box is defined by an upper light receiving zone 66, an outer end surface, two side surfaces 73 and 74, and a top plate 72. The lower box is defined by a lower light receiving zone 65, an outer end surface, two side surfaces 75 and 76, and a bottom plate 77, as shown in FIG. 7. As shown in FIG. 8, a light beam projecting source 63 is also arranged outside of a moving direction inspecting device 60, and located on a horizontal line which passes through the hole 62 and lies on the edge line 78.

A roving vibration device 50, which is mounted on the moving direction inspecting device 60, consists of an electromagnetic device 54, a bellow 53 connected to the electromagnetic device 54, and a piston chamber 51 provided with an air ejecting opening 52, wherein the air ejecting opening 52 is disposed on the top plate 72 of the moving direction inspecting device 60, so that air ejected downwardly from the opening 52 can affect a roving 1 passing through the space 67.

Figure 4:
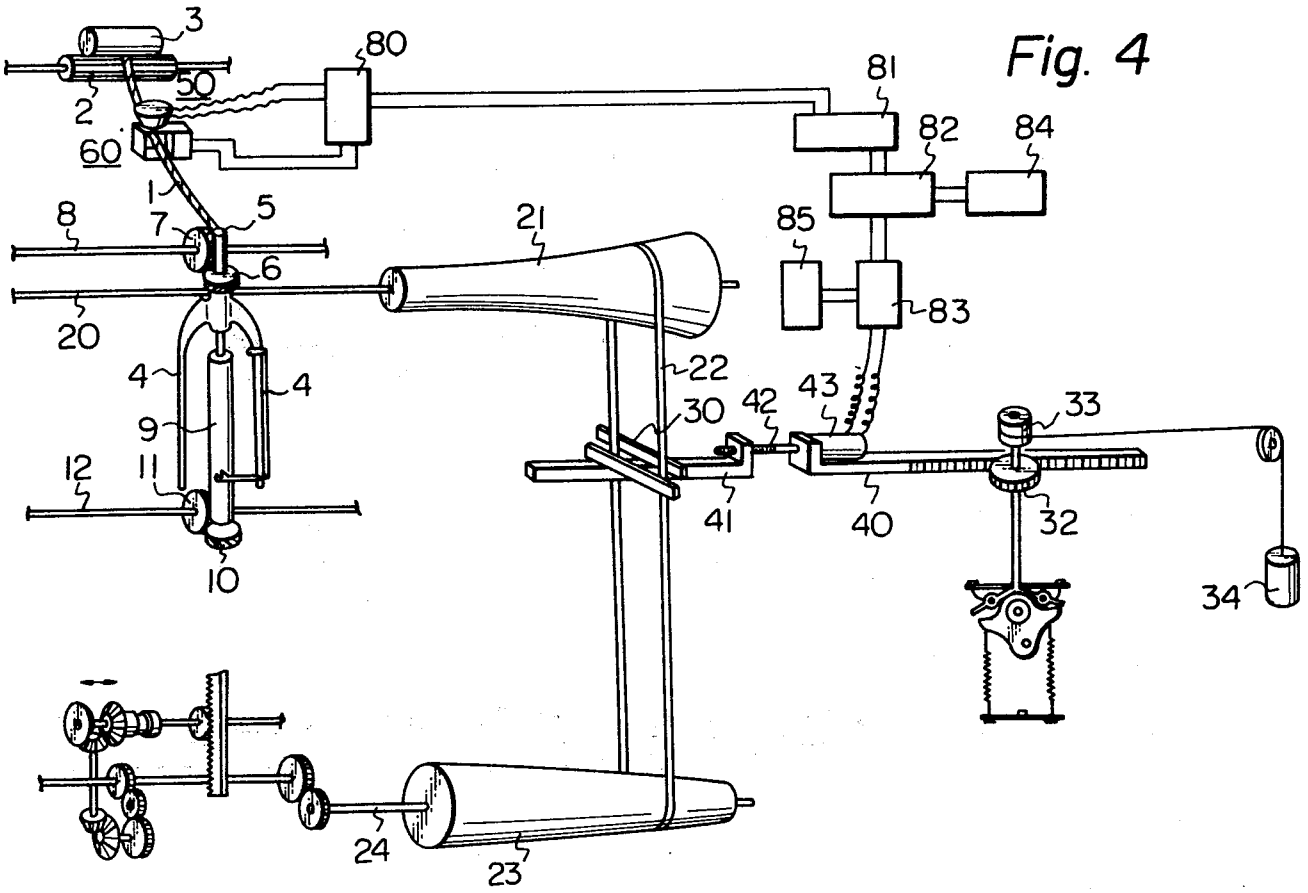
FIG. 4 shows a similar gearing diagram as that of FIG. 1, which illustrates a roving tension measuring device as well as a fine adjusting device of the present invention located on the roving frame as shown in FIG. 1.

In an embodiment of the present invention, as shown in FIG. 4, a roving tension measuring device, which consists of the roving vibration device 50 and the moving direction inspecting device 60, is disposed in between a nip of the front roller 2 and the top 5 of the flyer so that a roving 1 running from the nip of the front roller 2 toward the top 5 of the flyer can pass through the space 67 of the device 60, without interference by the device.

An amplifier 80 is electrically connected to the two upper and lower light receivers 70 and 71, which are mounted on the top and bottom outer end surfaces, respectively, and also electrically connected to windings 55 of the electromagnetic device 54.

The output terminal of the amplifier 80 is connected to a relay 83 via a frequency measuring device 81 and a comparison circuit 82, which is accompanied by a predetermined rate indicating device 84. The relay 83 provided with a timer 85 is electrically connected to a control motor 43, which is of a reversible type, as shown in FIG. 4, and also fixedly mounted onto a long rack piece 40 with rack teeth. Between the long rack piece 40, as shown in FIG 4, and a belt fork piece 41 provided with a belt fork 30, an adjusting screw 42 is arranged in such a way that it can be screwed into the screw hole of the belt fork piece 41 while it is rotated by means of the control motor 43.

The operational sequence of the present invention apparatus is as follows.

A roving 1 attenuated from a sliver and delivered from the nip of the front roller 2 of the draft assembly enters into the top 5 of the flyer 4. The roving 1 is twisted by the number of revolutions of the flyer 4 so that it acquires a predetermined number of twists per unit length of the roving 1. A roving 1 passes through the top hole provided on the top 5 of the flyer 4 and enters into the outer surface of a bobbin 9 after being guided by a guide surface of a hollow leg provided on the flyer 4, as well as being guided by the flyer presser provided on the flyer 4, wherein the speed of the bobbin 9 is always maintained higher than the speed of the flyer 4, so that a roving 1 can be wound in one layer on the bare surface of a bobbin 9 or on the outer surface of the package formed on the bobbin 9.

Since the roving 1 is running from the nip of the front roller to the top 5 of the flyer 4 and since the roving is turned around on its axis so that a given twist is applied thereto, the roving 1 can be easily moved up and down.

When an outside force, such as one caused by a downwardly ejected air for vertically vibrating the roving, is applied onto a roving 1, the roving starts its vibration with a frequency which corresponds to the strength of the tension on the roving 1.

The condition of moving the roving 1 downwardly can be detected by the following method. Since the roving 1 travels toward the top 5 of the flyer 4 after passing through the space 67 of the moving direction inspecting device 60, and after vibrating within the space without touching the walls of the device 60, and since a light beam emitted from the light beam ejecting source 63 enters into the side of the vibrating roving 1 after passing through a hole 62 on the vertical screen plate 61, a silhouette of the roving is projected onto a lower light beam receiving zone 65 or onto an upper light beam receiving zone 66. The disposition of the device 60 with respect to the roving 1 can be varied, i.e., sometimes the highest and lowest rovings can be situated only within the upper light receiving zone 66 or only within the lower light receiving zone 65. However, the silhouette will normally fall on the upper light receiving zone 66 as well as on the lower light receiving zone 65, because the roving 1 is disposed at the center of the space 67.

During the time when the roving 1 is moving downwardly, the length of the silhouete of the roving within the upper light beam receiving zone 66 becomes gradually shorter, while the length of the silhouette of the roving within the lower light beam receiving zone 65 becomes gradually longer, as shown in FIG. 6.

When converting data corresponding to the bright portions of both light beam receiving areas to respective voltage values by means of the light receivers 70 and 71, respectively, such obtained voltage values can be used for determining the direction in which the roving is moving. If the resultant voltage value obtained by reducing the value of the voltage of the lower light receiver 71 from the value of the voltage of the upper light receiver 70, shows the tendency to gradually increase, this information can be used to confirm the fact that the roving is moving downwardly.

Figure 10:
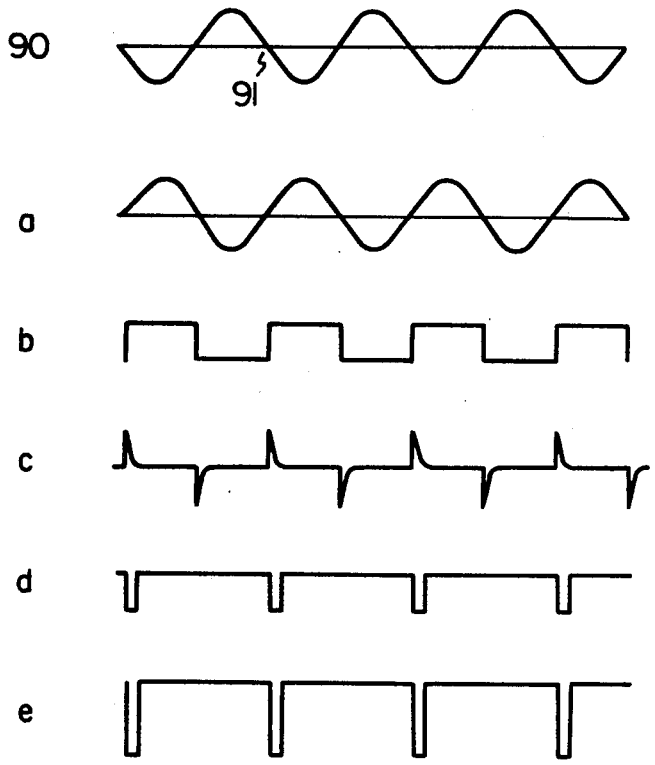

In FIG. 10, as a wave 90 of the vibration of a roving 1 shows a simple harmonic motion, therefore, a position 91 on the wave 90 corresponds to the position at which a roving 1 is moving vertically within a vertical plane at its maximum speed. Consequently, in the present invention, a negative pulse which corresponds to the position 91 on the wave 90, as shown in FIG. 10-e, can be produced by using a coventional electrical circuit.

By sending these negative pulses to the windings 55 on the roving vibration device 50 in FIG. 8, an electromagnetic device 54 can be energized at time intervals which are equal to time intervals corresponding to the frequency of the wave 90. When this electromagnetic device 54 is energized, the bellow 53 will thereby be pushed downwardly. As a result, the volume of the piston chamber 51 is reduced. Therefore, by the reduction of the volume, air within the chamber 51 can be ejected downwardly from the chamber after passing through the air ejecting opening 52.

Consequently, the time intervals of the air jets are equal to the time intervls of the frequency of the wave 90, produced by a vibration of the roving 1, which frequency corresponds to the tension occurring on the roving.

As the air jet ejected from the roving vibration device 50 vibrates a roving 1 when it is moving downwardly, the vibration of the roving can thus be maintained for a long time due to the air jet which accelerates the downward movement of the roving.

Accordingly, the frequency of a negative pulse, produced by the moving direction inspecting device 60 and by the roving vibrating device 50, is compared by a comparison circuit 82 with the predetermined frequency which is displayed by means of a predetermined rate indicating device 84. If the compared result is greater or less than the predetermined rate, the result can be used to compensate the speed of the bobbin 9 by increasing or decreasing the speed.

The signal produced by the amplifier 80, which is connected to the moving direction inspecting device 60 as well as to the roving vibration device 50, is transmitted to the control motor 43 mounted on the long rack piece 40 via an electrical unit which consists of a frequency measuring device 81, a comparison circuit 82, a predetermined rate indicating device 84, a relay 83 and a timer 85. This arrangement of the electric elements within the electric unit is well-known in this field and not at all particular to the present invention.

Figure 2:
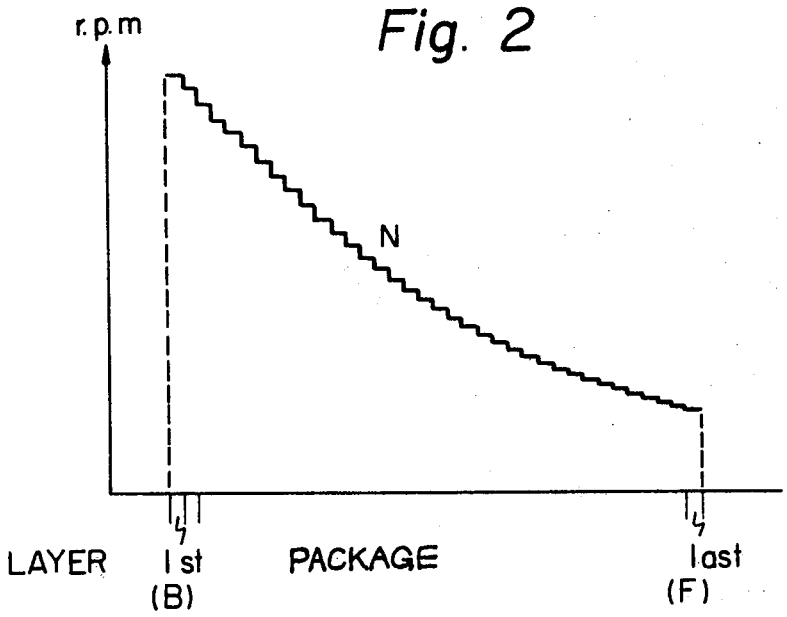
FIG. 2 shows a fundamental variable speed curve corresponding to the number of revolutions of a bobbin from the time when the first roving layer is wound onto the bobbin until the time the last roving layer is wound thereon.
Figure 3:
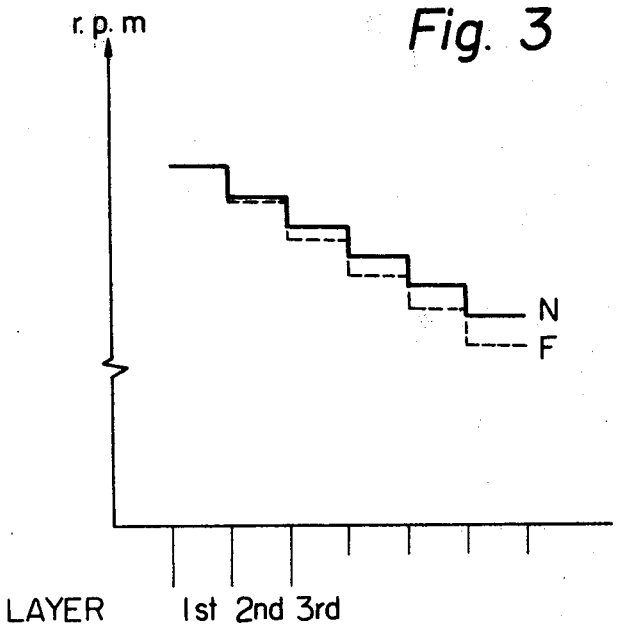
FIG. 3 shows an enlarged view of the curve similar to FIG. 2, and a modified variable speed curve modified by means of the present invention.

The compensation of the speed of the bobbin can be carried out by rotating the control motor in the normal direction, i.e. from right to left in FIG. 4, thereby shifting the belt 22 forwardly, or by rotating the motor in a reverse direction, thereby shifting the belt 22 backwardly, via the rotation of the adjusting screw 42. Thus, fine adjustment of the fundamental varied speed of the bobbin can be performed, as shown in the graph of FIG. 3. The stepwise variable speed of a bobbin being formed into a package by winding from the first roving layer (B) to the final roving layer (F), is shown in the graph of FIG. 2.

When one roving layer is wound onto a bobbin or onto an outer surface of a package during formation of a package on a roving frame, the speed of the bobbin is not adjusted at all. Consequently, the speed change is stepwise, because the speed of the bobbin is varied every time a new roving layer is wound onto a preceding roving layer already wound on the bobbin. This stepwise speed change is shown by the curve N in FIG. 2. This fundamental variable speed is generally determined by the configuration of the top and bottom cone drums 21 and 23, as mentioned hereinbefore. Therefore, the curve N can refer to a fundamental speed curve.

When the bobbin turns at a speed designated by the curve N, wherein the roving tension is higher or lower than a predetermined tension, the curve N must be modified to the curve F as shown in FIG. 3. Such modification can be carried out by the method and the apparatus of the present invention. At a result of modifying the roving tension, the roving tension can be maintained constant even until the last layer of the roving has been wound.

Figure 9:
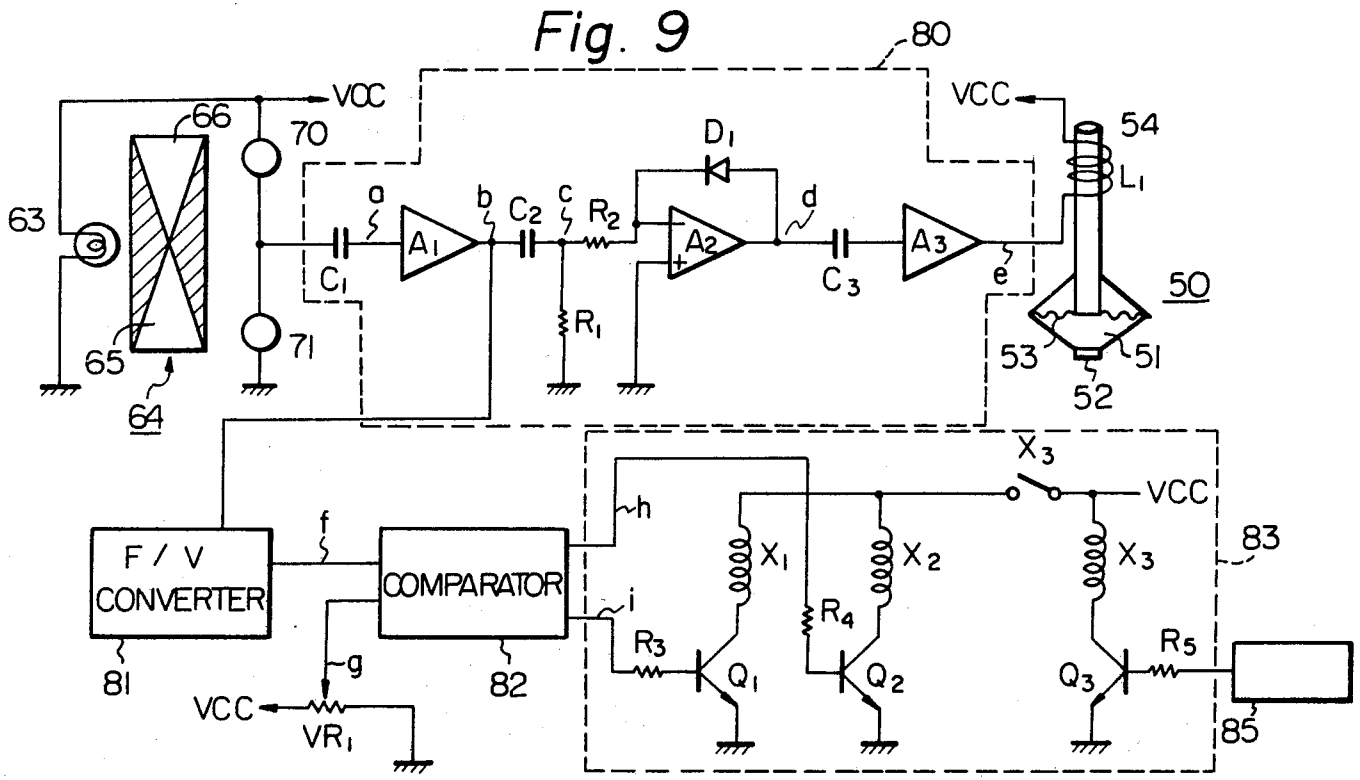
FIG. 9 shows an electrical wiring diagram for the combination shown in FIG. 8; and, FIG. 10 shows six different waveforms corresponding to the sequence of steps for converting a wave form corresponding to the vibration of the roving to a plurality of negative pulses.

FIG. 9 is a circuit diagram of the present invention. The wave diagrams in FIG. 10 show the sequential conversion of a wave 90 into a plurality of negative pulses in accordance with the circuit diagram. In FIG. 10, the top drawing illustrates the wave 90 of a vibrating roving, while FIG. 10-*a* illustrates a corresponding sine wave 90 produced in accordance with a variation of the voltage obtained at a point "a" in the diagram of FIG. 9. This varied voltage corresponds to the voltage difference between the voltages flowing from the upper light receiver 70 and the lower light receiver 71, respectively. The square voltage wave shown in FIG. 10-*b* is converted from the wave representing the vibration of roving 1 by means of the amplifier "$A_1$" in FIG. 9. Thereafter, the square wave is converted into a curve as shown in FIG. 10-*c* by means of a differential circuit, which consists of the element "$C_2$" and "$R_1$", because the value of the time constant of the circuit is substantially smaller than the frequency of the vibration of the roving 1. Consequently, negative pulses illustrated in FIG. 10 indicate the positions of the maximum upward moving speed of a roving 1, while positive pulses indicate the positions of the maximum downward moving speed of the roving 1. In FIG. 9, a clipping circuit, which consists of a diode "$D_1$" and a differential amplifier "$A_2$," is shown. The positive pulses shown in FIG. 10-*c* can be converted into negative pulses shown in FIG. 10-*d* by means of the clipping circuit. The negative pulses shown in FIG. 10-*d* can be amplified to form the negative pulses shown in FIG. 10-*e*, by means of a power amplifier "$A_3$," for operating the roving vibration device 50 when required.

Generally, when the first layer of roving is wound onto a bobbin, the roving running from the nip of the front roller to the top of the flyer will show a passage of roving which sags downwardly. However, the sagging passage will disappear if the winding is carried out on several layers already wound on the bobbin, whereby the passage of the roving will become almost straight.

Occurrences of such variation of the roving passage can be completely prevented by applying the present device to a conventional roving frame, because the tension of the roving can be maintained constant. Any occurrence of an irregular draft on a roving extending from the front roller to the wound package can be completely eliminated. As a result, the spun yarn from the roving will exhibit an excellent uniformity.

In cases where the speed of the flyer is increased, generally, the roving tension must be increased correspondingly. Accordingly, in all cases without fail, the roving passage does not sag to any extent. Consequently, even if the tension of the roving is increased, the passage will always remain straight. In such case, the apparatus of the present invention can be used to effectively measure the tension occurring on the roving. As a result, the apparatus of the present invention can be applied to high-speed roving frames.

Furthermore, as the size of the roving vibration device 50 and the size of the moving direction inspecting device 60 are quite small and as the mechanisms of both devices are simple, the apparatus of the present invention can therefore be easily assembled on any roving frame, which is currently being used in spinning mills, with some slight modifications.

What is claimed is:

1. A method for winding a roving onto a bobbin with a constant tension in a bobbin-lead type roving frame, which comprises a drafting assembly used for attenuating a fed sliver into a thinner roving, a flyer for producing a predetermined number of twists on said roving, a bobbin rotating at a variable speed by means of a variable speed bobbin drive mechanism, characterized by the steps of:

applying external forces vertically onto said roving running from the nip of the front rollers to the top of said flyer so that said roving can be vibrated at a frequency corresponding to the roving tension;

measuring said vibration frequency with a measuring device, while said roving is vibrating without touching said measuring device, comparing said measured vibration frequency with a predetermined frequency value; and adjusting the speed of a bobbin by using said comparison results until said measured frequency is equal to the predetermined frequency.

2. A method as claimed in claim 1, further characterized by applying said external force on said roving at time intervals equal to time intervals corresponding to the frequency of roving vibration.

3. A method as claimed in claim 2, further characterized by using said time intervals for measuring the frequency of vibration of vibrating roving, which is increased in accordance with an increase of said roving tension, and vice versa.

4. A method as claimed in claim 2, further characterized by applying said external forces onto said vibrating roving each time said roving moves either downwardly from the uppermost point to the lowermost point or upwardly from the lowermost point to the uppermost point.

5. A method as claimed in claim 4, further characterized by applying said external forces onto said vibrating roving each time said roving moves downwardly from the uppermost point to the lowermost point.

6. A method as claimed in claim 4, further characterized by applying an air jet onto said vibrating roving each time said roving moves either downwardly from the uppermost point to the lowermost point or upwardly from the lowermost point to the uppermost point.

7. A method as claimed in claim 6, further characterized by applying an air jet onto said vibrating roving each time said roving moves downwardly from the uppermost point to the lowermost point.

8. A method as claimed in claim 7, further characterized by applying said air jet onto said roving each time said roving is moving downwardly at maximum speed.

9. A method as claimed in claim 4, further characterized by applying said external forces on a roving at a position which is almost halfway between the nip of the front roller and the top of the flyer.

10. A method as claimed in claim 4, further characterized by detecting the downward movement of said roving.

11. A method as claimed in claim 10 further characterized by directing a light beam horizontally toward one side of said roving;

projecting a silhouette of said roving produced by means of said light beams onto a triangular light beam receiving zone, sensing the bright areas projected onto an upper triangular and a lower triangular area; and comparing said bright areas projected on said upper and lower triangular areas by subtracting the bright area of said lower triangular area from the bright area of said upper triangular area for detecting the moving direction of a roving.

12. A method as claimed in claim 11, further characterized by using said comparison results to actuate ejection of an air jet, wherein such comparison results are gradually increased when the bright area of said lower triangle is subtracted from the bright area of said upper triangle, for determining the moving direction of said vibrating roving.

13. An apparatus for carrying out the method as claimed in claim 1 comprising, in combination:

means for forcibly vibrating a roving running from the nip of the front rollers to the top of the flyer within a vertical plane;

a moving direction inspecting means for detecting a downward movement of a roving being vibrated vertically;

means for measuring a frequency of the roving vibration corresponding to the roving tension;

a comparing means for detecting the difference between said measured frequency and the predetermined frequency; and an adjustment means for adjusting the speed of a bobbin and for adjusting the fundamental variable speed induced by the variable speed bobbin driving mechanism.

14. An apparatus as claimed in claim 13, wherein means for forcibly vibrating a roving comprises an air pump for ejecting one air jet during each time of operation.

15. An apparatus as claimed in claim 14, wherein said air pump comprises:

a piston chamber provided with one air ejection opening; and an electromagnetic device provided with windings, which receives a pulse generated from a moving direction detecting means.

16. An apparatus as claimed in claim 15, wherein said air pump further comprises a bellow which constitutes a top wall of said piston chamber and which is operated by said electromagnetic device.

17. An apparatus as claimed in claim 13, wherein said moving direction inspecting means comprises:

a light beam projecting source;

an inspecting device consisting of a screen plate with one hole, a light receiving plate with upper and lower triangular light beam receiving zones provided with a common apex and disposed opposite said apex, two prism-shape boxes provided with with two outside surfaces, respectively, and a space located between said screen plate and said light beam receiving plate;

upper and lower light beam receivers disposed on said two outside surfaces, respectively; and a device for detecting the downward movement of said roving.

18. An apparatus as claimed in claim 13, wherein means for measuring a frequency of the roving vibration comprises:

a pulse generating device for converting a signal generated from said detecting device into pulses after converting a bright area into a corresponding voltage value; and a frequency measuring device for measuring a frequency which corresponds to time intervals between adjacent pulses.

19. An apparatus as claimed in claim 18, wherein a pulse generating device generates one pulse each time a roving is moving downward at maximum speed.

20. An apparatus as claimed in claim 13, wherein said comparing means comprises:

a predetermined frequency rate indicating device; and a comparison circuit for comparing a predetermined frequency with a measured frequency of the roving vibration.

21. An apparatus as claimed in claim 20, wherein said adjusting mechanism comprises:

a long rack piece having rack teeth;

a belt fork piece provided with a belt fork and a screw hole; and an adjusting screw rotated by said reversible type motor mounted on said long rack piece and engaged with said screw hole.

22. An apparatus as claimed in claim 13, wherein said adjusting means comprises:

a reversible type control motor rotating in either direction in accordance with a signal generated from said comparison circuit; and a adjusting mechanism for adjusting a position of a belt fork.

* * * * *